US005765652A

United States Patent [19]

Mathis et al.

[11] Patent Number: 5,765,652

[45] Date of Patent: Jun. 16, 1998

[54] UNIVERSAL JOINT FOR A MOTORIZED IMPLEMENT

[75] Inventors: Mark E. Mathis, Chandler; Robert L. Sauer, Tempe; Lakhbir S. Suchdev, Phoeniz, all of Ariz.

[73] Assignee: Ryobi North America, Inc., Easley, S.C.

[21] Appl. No.: 675,957

[22] Filed: Jul. 5, 1996

[51] Int. Cl.[6] ..... B25D 15/00

[52] U.S. Cl. ..... 173/217; 173/216

[58] Field of Search ..... 173/216, 217, 173/171; 408/127

[56] References Cited

U.S. PATENT DOCUMENTS

| | | | |
|---|---|---|---|
| 2,543,979 | 3/1951 | Maurer | 192/150 |
| 2,724,573 | 11/1955 | Lundquist | 255/41 |
| 2,869,907 | 1/1959 | Deliso | 287/126 |
| 3,242,998 | 3/1966 | Gubbins | 173/217 |
| 3,243,093 | 3/1966 | Schaefer, Jr et al. | 227/146 |
| 3,526,282 | 9/1970 | Newman | 173/93.6 |
| 3,827,510 | 8/1974 | Mazepa | 173/163 |
| 3,873,863 | 3/1975 | Pew | 173/217 |
| 4,512,692 | 4/1985 | Nielsen | 408/226 |
| 4,905,423 | 3/1990 | van Laere | 51/181 R |
| 4,913,242 | 4/1990 | Lo | 173/12 |
| 4,946,422 | 8/1990 | Lindenthal et al. | 464/135 |
| 5,199,833 | 4/1993 | Fehrle et al. | 408/239 R |
| 5,372,420 | 12/1994 | Van Deursen et al. | 366/129 |

*Primary Examiner*—Scott A. Smith
*Attorney, Agent, or Firm*—Brooks & Kushman P.C.

[57] ABSTRACT

A motorized implement having a housing containing a motor mounted therein the motor having a rotary shaft with an output end. The motorized implement further has a drive shaft with an input end pivotably supported relative to the housing and co-axially aligned with the rotary shaft. Moreover, the implement has a connector interposed between the motor and the drive shaft, which includes a pair of co-axial apertures, one to cooperate with the input end of the drive shaft to form a first connection. The other of the pair of apertures to cooperate with the output end of the rotary shaft to form a second connection. One of the first and second connections is securely fixed to its associated shaft end, and the other forms a pivotal universal joint. The aperture and associated shaft end which form the universal joint have corresponding non-circular cross-sections for enabling a slip-fit connection. The universal joint facilitates slight misalignment between the rotary shaft and the drive shaft.

12 Claims, 3 Drawing Sheets

UNIVERSAL JOINT FOR A MOTORIZED IMPLEMENT

CROSS-REFERENCE TO RELATED APPLICATION

This application is related to currently pending U.S. Design patent application No. 29/041,877 entitled "Rotary Tool" and assigned to the assignee of the present application, now Design Pat. No. D378,727.

TECHNICAL FIELD

This invention relates to a universal joint for a motorized implement.

BACKGROUND ART

Manufacturers of motorized implements and tools must balance several factors in designing new products. As a starting point, these factors necessarily include choosing a motor with the desired type and rating, as well a choosing a method of connection between the motor and the shaft of the driven implement or tool. Such decisions are usually made in conjunction with other manufacturing influences including, among other things, tooling costs, production costs and quality, operating environment and operator safety considerations.

Motorized implements typically include a housing, a motor and a single-member drive shaft directly coupled to the motor. The housing encloses the motor and the drive shaft, while the motor generates the power necessary to operate the drive shaft. Further, the motor is insulated in order to inhibit noise and protect the user against electric shock.

For many applications, a motor incorporating a unique drive shaft is commonly tooled-up with each new product. This is necessary due to the unavailability of standard off-the-shelf motor and drive shaft combinations suitable for every desired application. The extra tooling costs add to the final tooling, production and maintenance costs of the complete assembly.

Further, in the area of motorized implements, it is widely understood that the motor typically requires regular maintenance attention, in the form of repair or replacement. A tooled motor/drive shaft combination that burns out and necessitates replacement becomes an expensive proposition.

Consequently, the improved motorized implement should provide for a cost-effective assembly capable of using a standard off-the-shelf motor having a rotary shaft connected by a separate intermediate connector to an implement drive shaft. This connector thus provides for a universal joint pivotal about one of the shafts and also provides an additional source of insulation between the motor and the drive shaft.

SUMMARY OF THE INVENTION

It is a principal object of the present invention to provide a motorized implement in which a motor is connected to a drive shaft of the implement by a connector and thereby providing for a universal joint between the components.

It is a further object of the present invention to provide a motorized implement which utilizes a standard off-the-shelf motor rather than a specially tooled motor.

It is yet a further object of the present invention to provide a motorized implement having an additional source of insulation to isolate the motor from the drive shaft.

In carrying out the above objects, features and advantages of the present invention, there is provided a motorized implement having a housing containing a motor mounted therein. The motor has a rotary shaft with an output end. The implement further includes a drive shaft having an input end which is pivotably supported relative to the housing and generally co-axially aligned with the rotary shaft of the motor.

Further included is a connector interposed between the motor and the drive shaft, the connector having a pair of co-axial apertures. One of the pair of co-axial apertures cooperates with the input end of the drive shaft to form a first connection. The other one of the pair of co-axial apertures cooperates with the output end of the rotary shaft forming a second connection. One of the first and second connections is securely fixed to the associated shaft end and the other one of the connections forms a pivotal universal joint.

The universal joint is formed such that the aperture and associated end of the shaft have corresponding non-circular cross-sections for enabling a slip-fit connection. Further, the universal joint facilitates slight misalignment between the rotary shaft and the drive shaft, so that when the motor is activated, the rotary shaft rotates the connector which, through operation of the universal joint, in turn provides rotation to the drive shaft.

The above objects and other objects, features and advantages of the present invention are readily apparent from the following detailed description of the best modes for carrying out the invention when taken in connection with the accompanying drawings wherein like reference numerals correspond to like components.

BEST MODE FOR CARRYING OUT THE INVENTION

Figure 1:
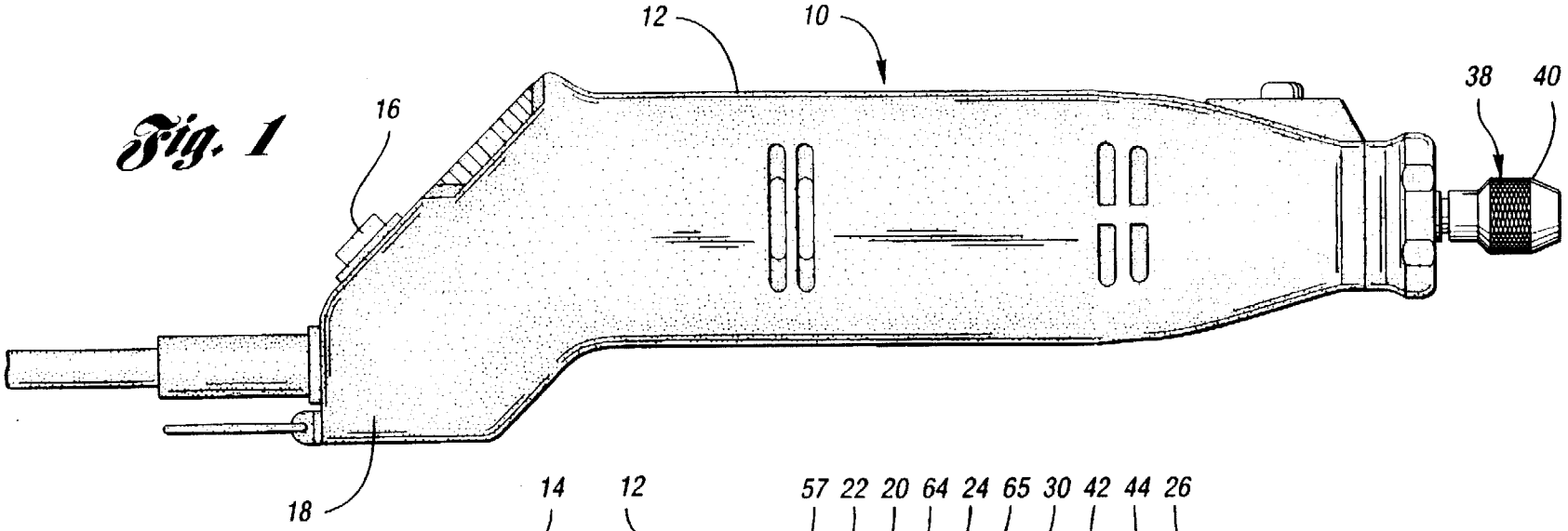
FIG. 1 is a side elevational view of a motorized implement exterior according to the present invention.

FIG. 1 of the drawings illustrates the exterior shell or housing of a motorized implement according to the present invention. The motorized implement is shown representatively in FIG. 1 as a rotary tool 10. However, the motorized implement may be any such instrument that comprises a motor and a drive shaft.

As seen in FIG. 1, the rotary tool 10 includes a housing 12 and an electric motor 14 mounted within the housing 12. A switch 16 is mounted to the handle portion 18 of housing 12 for operating motor 14. The present invention is designed to accommodate standard off-the-shelf or catalog motors, such as the electric motor 14 preferably used for rotary tool 10—the Mabuchi RT553PF or the Igarashi SN3658.

Figure 2:
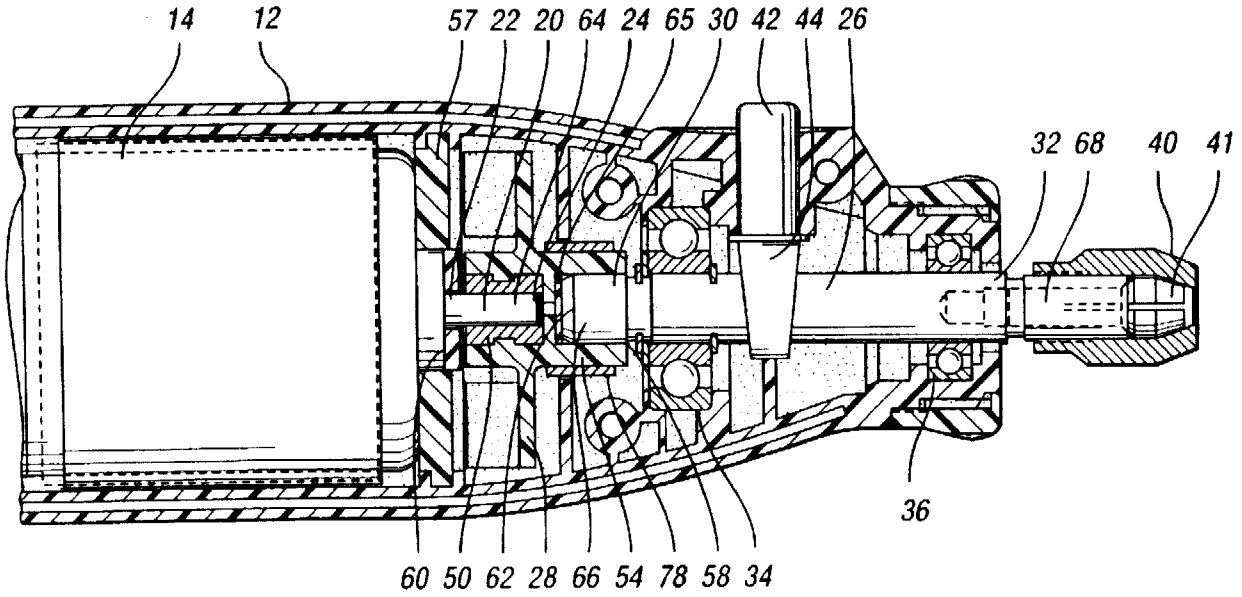
FIG. 2 is a side cut-away view of the motor, connector and associated shafts and their assembly according to the present invention.

Referring to FIG. 2, motor 14 has a motor rotary shaft (or rotary shaft) 20. Rotary shaft 20 of motor 14 has an input end 22 and an output end 24. Rotary tool 10 further includes a drive shaft 26 and a connector 28. The drive shaft 26 also has a respective input end 30 and output end 32. The drive shaft 26 is metallic and is preferably comprised of 0.45 carbon steel. Each end 30 and 32 of drive shaft 26 is rotatably supported relative to the housing 12, respectively by a first bearing assembly 34 and a second bearing assembly 36. The drive shaft 26 is generally co-axially aligned with the rotary shaft 20 of motor 14.

In the rotary tool 10 shown, the output end 32 of drive shaft 26 has coupled thereto a tool holder 38. As illustrated in FIGS. 1 and 2, and further by way of example but not limitation, tool holder 38 is a collet nut 40 and collet 41 for retaining a tool (not shown). Collet nut 40 is threaded onto drive shaft 26. It is understood by those skilled in the art, however, that tool holder 38 may be any component that allows a tool to be held to the motorized implement. Further, depending on the type of motorized implement at issue, tool holder 38 may not even be a necessary component.

The rotary tool 10 shown also includes a lock pin 42 which incorporates a lock pin spring 44. When lock pin 42 is depressed, lock pin spring 44 is correspondingly moved into contact with the drive shaft 26. In the proper orientation, the lock pin spring 44 is received by one of two lock pin openings 46 (shown in FIGS. 3*a* and 5*a*) in drive shaft 26, thereby locking drive shaft 26 and fixing its position. Once the drive shaft is locked and thus no longer freely spinning, the operator is able to either tighten or loosen collet nut 40, and thereby insert or remove the tool (not shown), respectively.

In a preferred embodiment, connector 28 is a molded plastic portion 48 having a metallic bushing 50 (or metallic insert). The molded plastic portion further includes a fan portion 52 and a connect portion 54. Fan portion 52 has fins 56 through which air is circulated for cooling motor 14 during operation of the rotary tool 10. This type of connector 28 is more particularly described herein as shown in FIGS. 4 and 6 and the text associated therewith.

As shown generally in FIG. 2, connector 28 is interposed or disposed between the motor 14 and the drive shaft 26, or more particularly, between the rotary shaft 20 and the drive shaft 26. As further shown in FIG. 2, a motor plate 57 may also be positioned between connector 28 and motor 14. The connector 28 has a pair of co-axial apertures 58 and 60. One of the apertures (shown in FIGS. 2 and 4 as aperture 58) cooperates with the input end 30 of the drive shaft 26 forming first connection 62. The other one of the pair of co-axial apertures (shown in FIGS. 2 and 4 as aperture 60) cooperates with the output end 24 of the rotary shaft 20 thereby forming second connection 64. As shown in FIG. 2, connector 28 may further include a spacer 65 positioned within the aperture 58. This allows input end 30 of drive shaft 26 to bottom-out on spacer 65 during assembly and operation.

One of the first and second connections (62 or 64) is formed by securely fixing connector 28 to an associated shaft end (24 or 30). The method of securely fixing such connection is preferably by way of a pressfit (or interference fit) of the appropriate shaft end (24 or 30) into its appropriate aperture (58 or 60). However, such a secure connection may also be via mechanical threading or other type of secured connection.

The other one of the first and second connections (62 or 64) forms a pivotal universal joint, wherein the remaining aperture (58 or 60) and its associated end of the shaft (24 or 30) have corresponding non-circular cross-sections for enabling a slip-fit (or non-interference) connection, thereby allowing for differences in dimensional tolerances between the mating components. The slip-fit between the aperture and shaft end of universal joint 66 allows for slight misalignment between the rotary shaft 20 and the drive shaft 26. Thus, when the motor 14 is activated the rotary shaft 20 rotates connector 28 which, through operation of the universal joint 66, in turn provides rotation to the drive shaft 26. The universal joint 66 is more particularly explained in association with the embodiments shown and discussed herein.

Figure 3A:
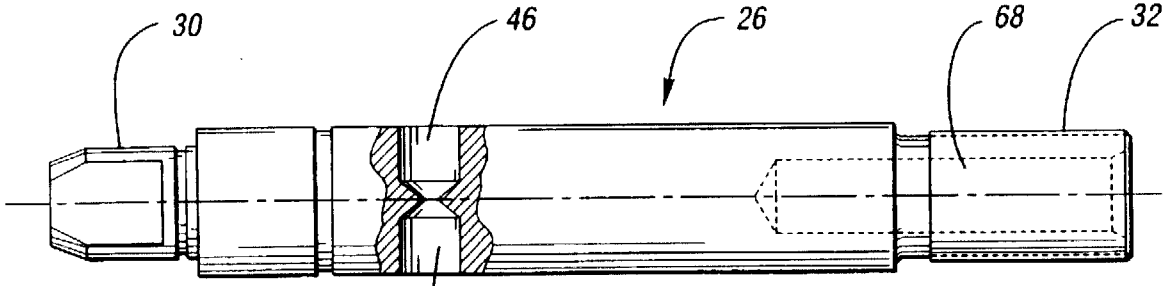
FIG. 3*a* is a side elevational view of a first embodiment of a drive shaft according to the present invention.
Figure 3B:
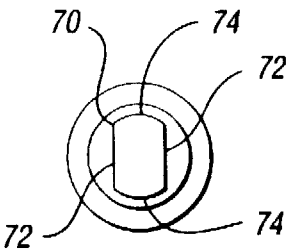
FIG. 3*b* is a rear elevational view of the drive shaft of FIG. 3 showing the double-D cross-section of the input end.

A first embodiment according to the present invention is shown in FIGS. 3–4. FIG. 3*a* illustrates a drive shaft 26, which as previously discussed, has an input end 30 and an output end 32. Drive shaft 26 further includes collet bore 68, which receives the shaft of the collet 41 of rotary tool 10. As more fully shown in FIG. 3*b*, input end 30 of drive shaft 26 includes a non-circular "double-D" shaped cross-section 70. This cross-section may be properly described as having two opposite flat sides 72 and two opposite convexly curved sides 74 as shown in FIG. 3*b*. This input end 30 is received by connector 28, or more particularly by a connect portion 54 of connector 28 shown in FIG. 4, thereby forming the first connection 62 previously described heretofore in association with FIG. 2. In this embodiment, the first connection 62 forms universal joint 66.

Figure 4C:
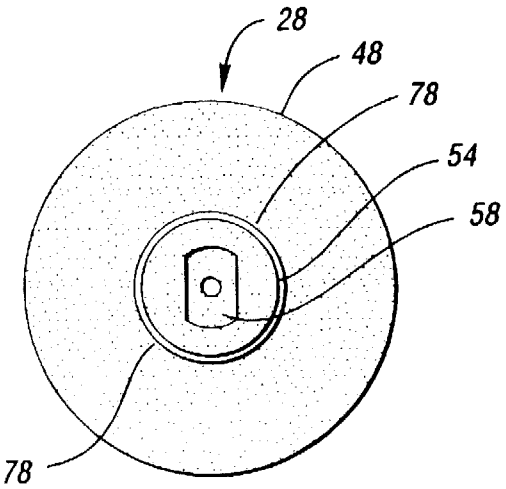
FIG. 4*c* is a front elevational view of the connector of FIG. 4*a;*

The connector 28, or the connect portion 54 thereof, includes one of the co-axial apertures (designated as 58), which has a corresponding non-circular "double-D" shape, as shown in FIG. 4*c*. The non-circular connection permits the female connector 28 and the male drive shaft 26 to mate by a non-interference slip-fit and thereby rotate together as a unit without slippage or cam-like movement.

This universal joint 66 operates in a manner similar to a socket wrench, wherein the non-circular cross-sections of the mating components (herein connector 28 and input end 30) provide at least one driving face wherein one of the mating components can drive the other. As a result, the chance of resultant slippage or cam-like movement between the components is avoided. Slippage would occur if such a connection were comprised two mating components having circular cross-sections that are not fixed together.

Figure 4B:
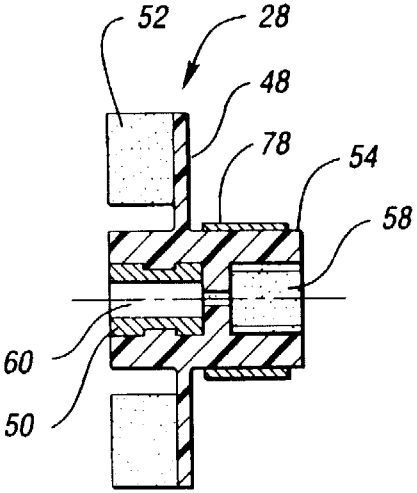
FIG. 4*b* is a side sectional view of the first embodiment of the connector taken along line 4*b*—4*b* as shown in FIG. 4*a;*
Figure 4A:
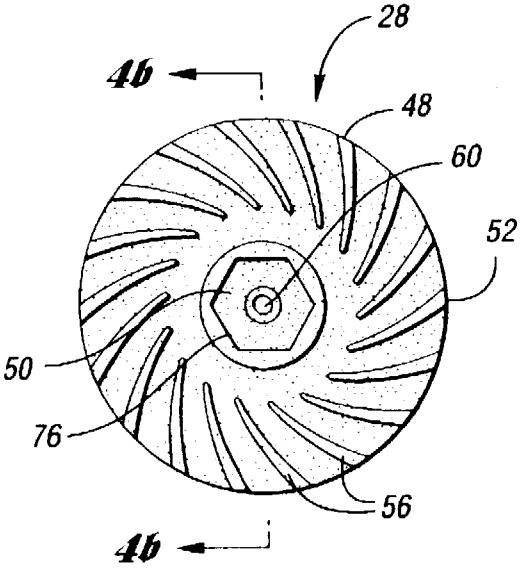
FIG. 4*a* is a rear elevational view of a first embodiment of a connector according to the present invention.

Further in this embodiment, rotary shaft 20 (discussed previously in association with FIG. 2) is preferably press fit into co-axial aperture 60 of connector 28 to form second connection 64. More particularly and as shown in FIGS. 4*a* and 4*b*, connector 28 is a molded plastic portion 48 which further includes a metallic bushing 50 (or metallic insert) which is insert molded therein. FIG. 4*a* illustrates that bushing 50 preferably has a hexagonal outer cross-section 76. However, the shape of this cross-section is not limited to a hexagon and may be any shape suitable for such an application. The metallic bushing 50 includes aperture 60 sized so that rotary shaft 20 is press fit into aperture 60.

Thus, while bushing 50 may be made of a conductive metal, the surrounding plastic connector 28 is non-conductive and thereby acts as an electrical insulator which serves to isolate motor 14 from drive shaft 26. However, as discussed above, such connection may be formed by other methods. Connector 28 is preferably comprised of 30% glass-filled nylon.

Lastly, it is understood that some fatigue or deformation may take place in connect portion 54 after countless revolutions of the rotary tool 10. For this reason, FIGS. 4*b* and 4*c* show a collar 78 having an inner diameter sized appropriately to slide over connect portion 54 to act as a barrier against any tendency of the connect portion 54 to fatigue and deform.

Figure 5A:
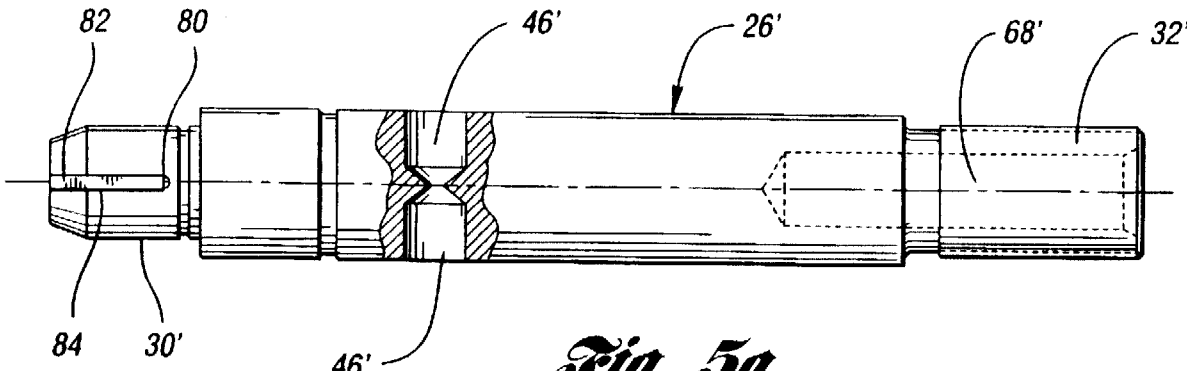
FIG. 5*a* is a side elevational view of a second embodiment of a drive shaft according to the present invention.
Figure 5B:
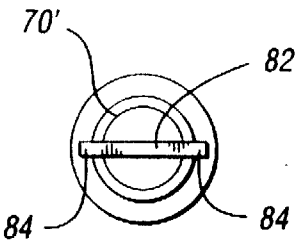
FIG. 5*b* is a rear elevational view of the drive shaft of FIG. 5*a* showing the cross-section of the input end.

A second embodiment according to the present invention is shown in FIGS. 5–6. Like components to those previously discussed will be designated in this embodiment by a prime designation (′). FIG. 5*a* illustrates a drive shaft 26′ having an input end 30′ and an output end 32′ As more fully shown in FIG. 5*b*, input end 30′ has a non-circular cross-section 70′ defined by a slot 80 with a plate 82 inserted therein, the ends 84 of plate 82 extending outwardly therefrom.

Figure 6C:
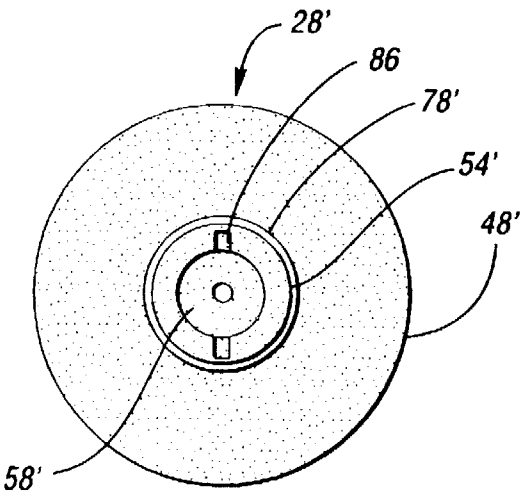
FIG. 6*c* is a front elevational view of the connector of FIG. 6*a*.
Figure 6B:
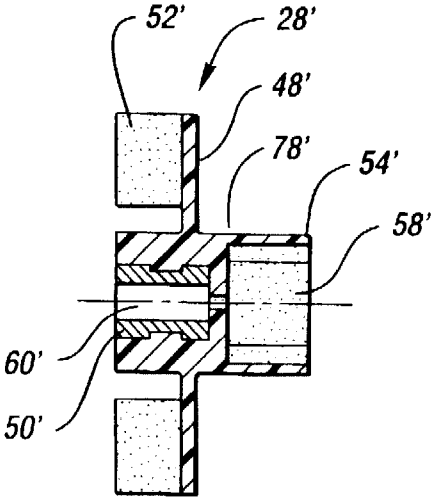
FIG. 6*b* is a side sectional view of the second embodiment of the connector taken along line 6*b*—6*b* as shown in FIG. 6*a*.
Figure 6A:
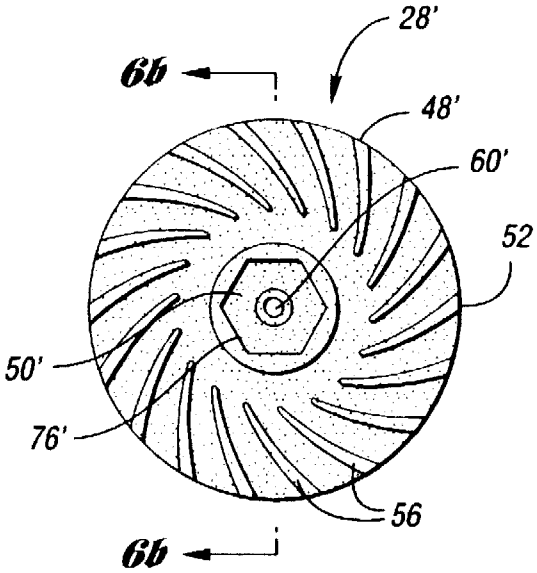
FIG. 6*a* is a rear elevational view of a second embodiment of a connector according to the present invention.

More particularly, plate 82 is longer than the diameter of the drive shaft 26′. Therefore, as shown in FIG. 5*b*, the ends 84 of plate 82 extend outwardly from slot 80 of drive shaft 26′. As shown in FIGS. 6*b* and 6*c*, this input end 30′ of drive shaft 26′ is received by a connect portion 54′ having one of the co-axial apertures 58′ of connector 28′. Again, this co-axial aperture 58′ has a corresponding non-circular cross-sectional shape, as shown in FIG. 6*c* and thereby forms the second connection previously described.

Specifically referring to FIG. 6*c*, the noncircular cross-section of aperture 58′ is defined by a circular section having two connector grooves 86 corresponding to the ends 84 of plate 82, for receiving and accommodating input end 30′, plate 82 and its ends 84. As before, the non-circular connection permits connector 28′ and the drive shaft 26′ to rotate together without slippage and without being secured together by a more secure connection, such as a press fit or interference fit.

For this second embodiment, the second connection 64 between rotary shaft 20 and connector 28′ is of the press-fit or interference type, and is similar to that discussed above in association with FIGS. 2 and 4. The rear view of connector 28′ shown in FIG. 6*a*, and its associated metallic bushing 50′ having aperture 60′, fan portion 52′ and fins 56′, is identical to the view shown in FIG. 4*a* and its related text.

Again, while the first and second embodiments is illustrated in FIGS. 3–6 and discussed above in relation thereto have involved the first connection 62 constituting universal joint 66, the invention clearly contemplates that second connection 64 may also form universal joint 66.

It is understood by those skilled in the art that any non-circular cross-sectional shape may be utilized for the drive shaft 26 and its corresponding aperture in connector 28 in order to carry out the purposes of the present invention. It is further understood that the embodiments shown are for purposes of illustration rather than of limitation.

While the best mode for carrying out the invention has been described in detail, those familiar with the art to which this invention relates will recognize various alternative designs and embodiments for practicing the invention as defined by the following claims.

What is claimed is:

1. A motorized implement, comprising:

a housing;

a motor having a rotary shaft with an output end, the motor mounted within the housing;

a drive shaft having an input end, the drive shaft rotatably supported relative to the housing, generally co-axially aligned with the rotary shaft of the motor; and a connector interposed between the motor and the drive shaft having a pair of co-axial apertures, one aperture cooperating with the input end of the drive shaft forming a first connection, and the other aperture cooperating with the output end of the rotary shaft forming a second connection, wherein one of the first and second connections is securely fixed, and the other connection forms a universal joint, wherein one of the pair of co-axial apertures and its associated one of the input end of the drive shaft and output end of the rotary shaft which form the universal point have corresponding non-circular cross-sections for enabling a slip-fit connection, and wherein the universal joint facilitates slight misalignment between the rotary shaft and the drive shaft, so that when the motor is activated, the rotary shaft rotates the connector which, through operation of the universal joint, in turn provides rotation to the drive shaft.

2. The motorized implement of claim 1, wherein the connector is provided with a fan portion for cooling the motor.

3. The motorized implement of claim 1, wherein the aperture and the end of the shaft forming the universal joint have corresponding double-D cross-sections.

4. The motorized implement of claim 1, wherein the end of the shaft forming the universal joint is provided with a slotted-end containing a plate projecting outwardly from the shaft.

5. The motorized implement of claim 1, wherein the rotary shaft is cylindrical and press fits into the connector.

6. The motorized implement of claim 5, wherein the connector is made of a molded plastic portion with a metallic insert having an aperture sized to press fit onto the rotary shaft, the plastic portion being nonconductive to serve as an electrical insulator thereby isolating the motor from the drive shaft.

7. An electric rotary tool, comprising:

a housing;

a motor having a rotary shaft with an output end, the motor mounted within the housing;

a drive shaft having an input end and an output end, the drive shaft rotatable supported relative to the housing, generally co-axially aligned with the rotary shaft of the motor, the output end including a tool holder; and a connector interposed between the motor and the drive shaft having a first aperture and a second aperture, the first aperture securely fixed to the output end of the rotary shaft and the second aperture cooperating with the input end of the drive shaft to form a universal joint wherein the second aperture and the input end of the drive shaft have corresponding non-circular cross sections for enabling a slip-fit connection for facilitating slight misalignment between the rotary shaft and the drive shaft, so that when the motor is activated, the rotary shaft rotates the connector which, through operation of the universal joint, in turn provides rotation to the drive shaft.

8. The electric rotary tool of claim 7, wherein the connector is provided with a fan portion for cooling the motor.

9. The electric rotary tool of claim 7, wherein the input end of the drive shaft and its associated aperture forming the universal joint have corresponding double-D cross-sections.

10. The electric rotary tool of claim 7, wherein the input end of the drive shaft is provided with a slotted-end containing a plate projecting outwardly from the shaft.

11. The electric rotary tool of claim 7, wherein the rotary shaft is cylindrical and press fits into the associated aperture of the connector.

12. The electric rotary tool of claim 11, wherein the connector is made of a molded plastic portion with a metallic insert having an aperture sized to press fit onto the rotary shaft, the plastic portion being nonconductive to serve as an electrical insulator thereby isolating the motor from the drive shaft.

* * * * *